US009840844B2

(12) United States Patent
Prowse

(10) Patent No.: US 9,840,844 B2
(45) Date of Patent: Dec. 12, 2017

(54) COMBINATION REINFORCING COUPLER AND COLUMN ALIGNMENT DEVICE

(71) Applicant: M3S HOLDINGS PTY LTD, Toowoomba (AU)

(72) Inventor: Steven Prowse, Toowong Brisbane (AU)

(73) Assignee: M3S HOLDINGS PTY LTD, Queensland (AU)

( * ) Notice: Subject to any disclaimer, the term of this patent is extended or adjusted under 35 U.S.C. 154(b) by 0 days.

(21) Appl. No.: 14/410,366

(22) PCT Filed: Jun. 26, 2013

(86) PCT No.: PCT/AU2013/000694

§ 371 (c)(1),
(2) Date: Dec. 22, 2014

(87) PCT Pub. No.: WO2014/000038

PCT Pub. Date: Jan. 3, 2014

(65) Prior Publication Data

US 2015/0292207 A1 Oct. 15, 2015

(30) Foreign Application Priority Data

Jun. 27, 2012 (AU) ..... 2012902731

(51) Int. Cl.
*E04C 5/16* (2006.01)
*E04B 1/41* (2006.01)
(Continued)

(52) U.S. Cl.
CPC ..... *E04C 5/165* (2013.01); *E04B 1/40* (2013.01); *E04B 1/4128* (2013.01);
(Continued)

(58) Field of Classification Search
CPC ... E04C 5/06; E04C 5/165; E04B 1/40; E04B 1/4128; E04B 1/5837; E04B 2001/5887
(Continued)

(56) References Cited

U.S. PATENT DOCUMENTS 3,820,293 A * 6/1974 Ohe et al. ..... E04B 1/2604 52/127.12
3,890,758 A * 6/1975 Bouchard ..... E04B 1/4128 248/650
(Continued)

FOREIGN PATENT DOCUMENTS

DE 1802881 9/1970
DE 1784807 11/1971
(Continued)

OTHER PUBLICATIONS

International Search Report dated Aug. 26, 2013, in connection with International Patent Application No. PCT/AU2013/00694, 4 pgs.
(Continued)

*Primary Examiner* — Patrick J Maestri
(74) *Attorney, Agent, or Firm* — Mattingly & Malur, PC

(57) ABSTRACT

An apparatus for aligning and joining construction elements comprising threaded studs or bars protruding from opposing elements; interlocking members adapted to screw together associated with each of the opposed studs; an adjustment nut screwable on one of the studs wherein, the adjustment nut is screw jacked against one of the interlocking members to align the elements and then locked and encapsulated by screwing together the interlocking members. There can be additional stud or bar alignment means associated with the apparatus.

13 Claims, 7 Drawing Sheets

(51) Int. Cl.
*E04B 1/58* (2006.01)
*E04C 5/06* (2006.01)

(52) U.S. Cl.
CPC ..... *E04B 1/5837* (2013.01); *E04C 5/06* (2013.01); *E04B 2001/5887* (2013.01)

(58) Field of Classification Search
USPC ..... 285/332
See application file for complete search history.

(56) References Cited

U.S. PATENT DOCUMENTS 3,898,770 A * 8/1975 Benz ..... B24B 37/102 451/286
5,305,573 A 4/1994 Baumann
6,065,263 A * 5/2000 Taguchi ..... E04B 5/023 403/305
2005/0023831 A1* 2/2005 Hughes ..... E21B 17/028 285/330
2012/0097816 A1* 4/2012 Tamm ..... F24J 2/5254 248/309.1

FOREIGN PATENT DOCUMENTS

| | | | |
|---|---|---|---|
| FR | 2668558 | A1 | 4/1992 |
| GB | 2255385 | A1 | 4/1992 |
| JP | 2001271425 | A | 10/2001 |
| KR | 200409526 | | 3/2006 |
| WO | 9208019 | A1 | 5/1992 |
| WO | 2007061240 | A1 | 5/2007 |
| WO | 2011113418 | A1 | 9/2011 |

OTHER PUBLICATIONS

International Preliminary Report on Patentability (Chapter II) dated May 15, 2014, in connection with International Patent Application No. PCT/AU2013/00694, 5 pgs.

* cited by examiner

COMBINATION REINFORCING COUPLER AND COLUMN ALIGNMENT DEVICE

FIELD OF THE INVENTION

This invention relates to the building industry, in particular but not limited to an apparatus for aligning and joining reinforced concrete elements, typically columns, walls and/or structural steel components.

BACKGROUND OF THE INVENTION

The joining of reinforced concrete elements such as columns, walls, floors and beams is a well known activity in the building industry. The problems associated with this construction process are manifold and commonly is dependent on the connection of opposed reinforcement bars or rods that may or may not be accurately aligned in order to transfer tensile, compression and other forces through the connection.

Prior art connection means are as varied as the applications themselves. A common prior art method of connecting reinforcement bars is by lapping one bar with another with a preferable overlap length normally forty times the bar diameter. While this method does not require the overlapping bars to be accurately aligned it does create congestion within the confines of the concrete element. This has resulted in the concrete element which is typically a column sometimes having to be larger simply to accommodate the additional bars. This results in a coincidental degree of waste associated with this prior art method. Other methods used to join reinforcement bars utilise mechanical connectors which are generally threaded or attached by an epoxy adhesive joining the projecting ends of the reinforcement bars. This method however requires the bars to be perfectly aligned. Furthermore this method is only satisfactory if there is a single bar to be aligned with an opposite bar. Prior art disclosures of such connection methods include those disclosed in Australian Patents 2003210074 (Barfix Bermuda Ltd) which discloses a method and device for connecting reinforcing steel bars involving a connecting element comprising a thread cutting portion which cuts a screw thread in one of the reinforcing bars. The thread cutting portion cuts a conical screw thread forming a conical screw end on the reinforcement bar.

AU2001051968 discloses a structural bracing system wherein there is disclosed a lockable nut system for the use of threaded steel bar which includes a locking member which is slightly engaged with the bar. The locking member may have a finger to engage the nut with the end of the finger being displaced as a result of the deformation of a finger actuating tab.

WO98/44215 (Bartix Bermuda Ltd) describes a method and apparatus for interconnecting reinforcement bars wherein the connector cuts the thread in an opposing reinforcing bar as it is tightened.

In all of the above-mentioned prior art documents, the method and apparatus for joining reinforcing bars relies on the accuracy of aligning reinforcement bars of opposed separate columns. In many situations however there are multiple bars such as a cluster of bars which require connection in a group. There are a few prior art mechanical connection systems available that provide for a tolerance in a slight misalignment between respective bars. In order to connect one cluster of bars to another cluster of bars, it can be very difficult and labour intensive to ensure that each individual bar in one cluster is accurately aligned with its respective and complementarily opposed individual bar in another cluster. Furthermore where the reinforcement bars in concrete or steel elements are not aligned and able to be mechanically connected, the elements themselves require props or other temporary means to align or support them before connecting their respective reinforcement bars which is both time and labour intensive. Prior art examples of mechanical bar or rod couples include U.S. Pat. No. 5,305,573 A (BAUMANN), WO2011/113418 A1 (BILFINGER BERGER AG), WO 1992/008019 A1 (ARTEON) and WO 2007/061240 A1 (KIM).

In all prior art examples, while the principal function is to couple reinforcing rods and bars, even if they may be slightly misaligned (eg. WO 1992/008019 A1 (ARTEON)) there is no alignment function of the concrete elements or steel components themselves in which the bars are embedded. There is therefore a need for an apparatus and a method for not only joining reinforcement bars of separate opposed columns, but that also aligns the columns with each other without the use of props of other temporary means and wherein the apparatus is also able to function when opposing reinforcement bars are misaligned.

OBJECT OF THE INVENTION

It is the object of the invention to ameliorate or eliminate some or all the problems and disadvantages associated with the prior art by providing a novel and inventive system for aligning and joining reinforcement bars of construction elements.

STATEMENT OF INVENTION

In one aspect the invention resides in an apparatus for aligning and joining construction elements typically reinforced concrete columns, walls, floors, beams or structural steel components comprising in combination:

one or more threaded studs or threaded reinforcement bars protruding from opposing elements to be aligned and joined:

first and second threaded interlocking members adapted to screw together and to be associated with each of the opposed studs;

an adjustment nut screwable on one of the studs or bars and adapted to be encapsulated or enclosed by the interlocking members;

wherein in use, the adjustment nut is screw jacked against one of the interlocking members to align the elements and then locked and encapsulated by screwing together the interlocking members.

In a more detailed example, the invention resides in apparatus for aligning and joining construction elements together including in combination;

a first threaded stud or threaded reinforcement bar imbedded in and protruding from an end from a first element; a second threaded stud or threaded reinforcement bar imbedded in and protruding from a second element to be aligned and joined with the first element;

a first tubular member fixedly attached to the first stud, the first tubular member having a threaded outer wall;

a second tubular member having an internal thread adapted to be screwed onto the first tubular member, the second tubular member having an end wall with a hole to enable the second tubular member to slide freely over the second stud or bar wherein the dimensions of the hole determines the tolerance required to accommodate any misalignment of the studs;

an adjusting nut screwable onto the second stud and in contact with the free end of the first tubular member wherein the first and the second elements are aligned by screw jacking the adjusting nut against the free end of the first tubular member or vice versa and wherein the second tubular member when screwed onto the first tubular member encapsulates and locks in place the adjustment nut.

Suitably, the elements are concrete columns or walls to be vertically aligned.

Preferably the diameter of the hole in the end wall of the second tubular member is equal to or greater than the internal diameter of the free end of the first tubular member.

Preferably there are one or more washers above and below the adjustment nut to facilitate turning of the adjustment nut. The washer may be designed to provide additional bearing capacity between the adjustment nut and the tubular members. The washer may also have a slotted hole that would allow for even more bearing capacity (surface area) in the most extreme misalignment allowed for.

In another version there are no washers and the adjustment nut may be designed to negate the need for any washers for example by having top and bottom flanges.

Suitably the first and second tubular members have hexagonal or flat-faced portions to facilitate turning with a spanner.

Optionally, there is one or more lock nuts which can be tightened against the first and second tubular members to further secure them on their respective threaded rods.

Preferably, there are also opposite studs or bar alignment means comprising a cap member having a central protrusion, the cap adapted to be fitted to the end of one stud or bar; the protrusion adapted to be inserted into a central cavity of an interlocking tubular member of an opposite stud or bar to substantially align the opposite studs or bars before screwing together the first and second interlocking tubular members of the studs or bars.

Preferably, the cap is friction welded or screwed onto the end of the one stud or bar.

Preferably, there are removable clips adapted to clip onto the studs or bars to temporarily support one or both of the interlocking tubular members on the studs or bars away from a capped end while inserting the protrusion of the cap into the central cavity to substantially align the opposite studs or bars.

In another aspect, the invention resides in a method of aligning reinforced concrete elements typically columns or walls and joining their reinforcement bars or studs using the apparatus as herein described including the steps of:

a) attaching preferably by screwing the first tubular member onto the first stud or bar;
b) sliding the second tubular member over the opposing second stud or bar;
c) screwing the adjustment nut onto the second stud or bar and bringing it into contact with the free end of the first tubular member,
d) tightening the adjustment nut against the first tubular member to align the first and second columns or walls or aligning substantially the first and second studs or bars with the stud or bar alignment means;
e) on obtaining the alignment desired, screwing the second tubular member on to the first tubular member and tightening the second and first tubular members together thereby encapsulating and locking into place the adjustment nut.

BRIEF DESCRIPTION OF THE DRAWINGS

In order for the invention to be better understood and put into practical effect reference will now be made to the accompanying drawings, wherein.

DETAILED DESCRIPTION OF THE DRAWINGS

Figure 1:
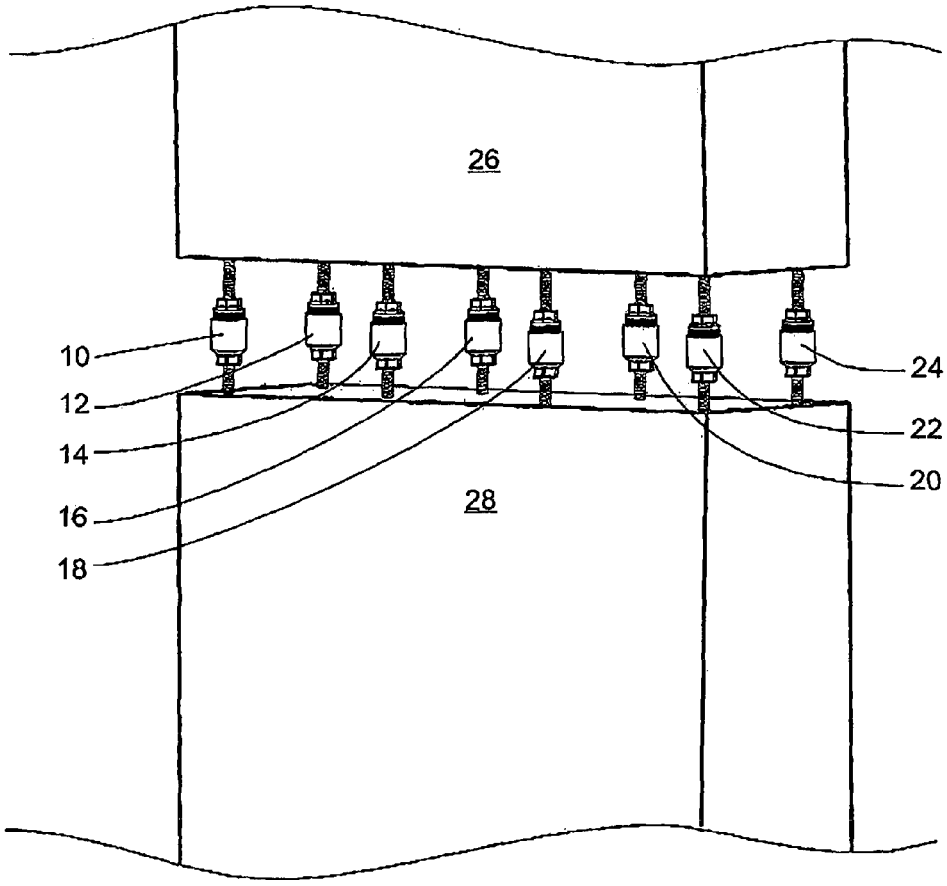
FIG. 1 shows the invention in use to align and join concrete columns.

Referring now to FIG. 1 there is shown a number of units of the invention 10, 12, 14, 16, 18, 20, 22, 24, in use to align and join rectangular concrete columns or opposed walls sections 26, 28.

It will be apparent that the number of the units of the invention required will depend on the load bearing specification and safety requirements in respect of the particular application. In this section a number of units have been used to align and join the concrete columns or walls.

Figure 2:
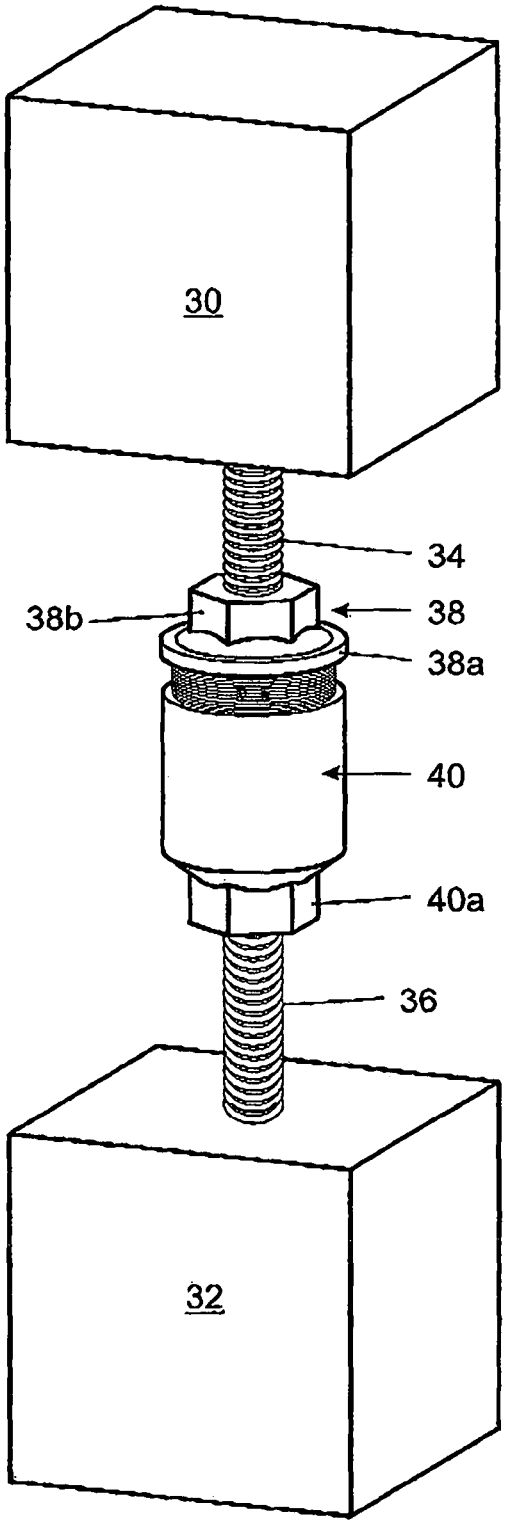
FIG. 2 shows a single unit of the invention in use.

Referring now to FIG. 2 there is shown the invention in use to join and align an upper 30 and a lower 32 construction element wherein the opposed threaded studs 34, 36 are substantially aligned and the top 38 and bottom 40 tubular members are tightened to encapsulate the adjustment nut (not shown). In this example the first tubular member has a flange 38*a* which provides added purchase or grip in concrete which is poured around the unit thereby sealing the unit.

In another aspect, the flange 38*a* also provides a means by which the tubular member 38 can be secured against an edgeform if it is required to be east into the construction element 30 leaving only the externally threaded tubular portion protruding from the construction element.

Both first and second (i.e. top and bottom) tubular members, have hexagonal portions 38*b*, 40*a* to facilitate tightening with an open ended spanner.

Figure 3:
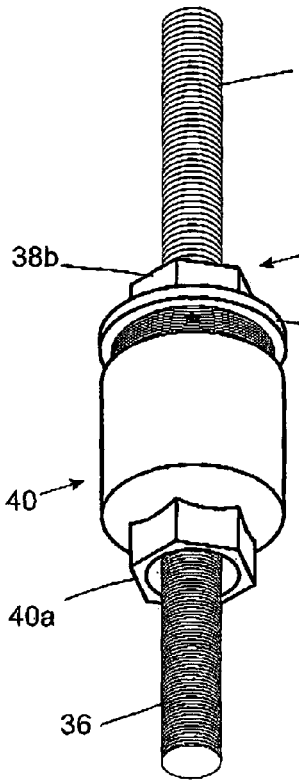
FIGS. 3, 4, 5 show various views of the invention.
Figure 4:
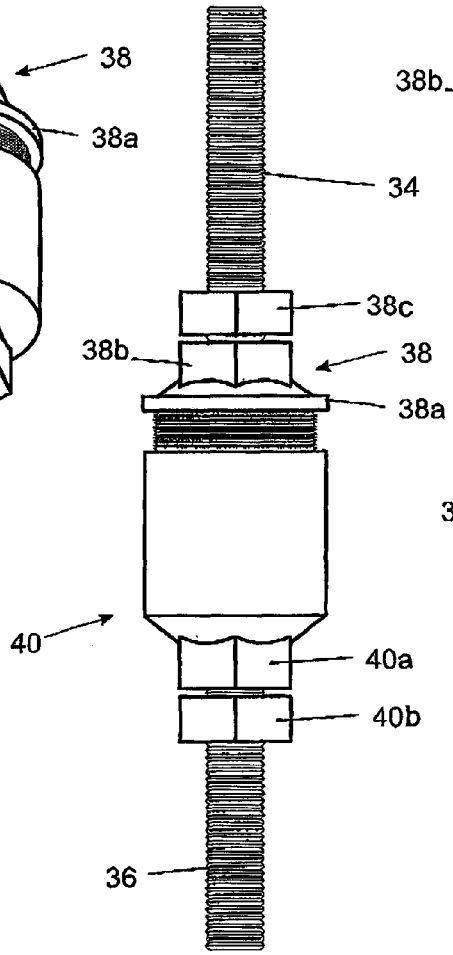
Figure 5:
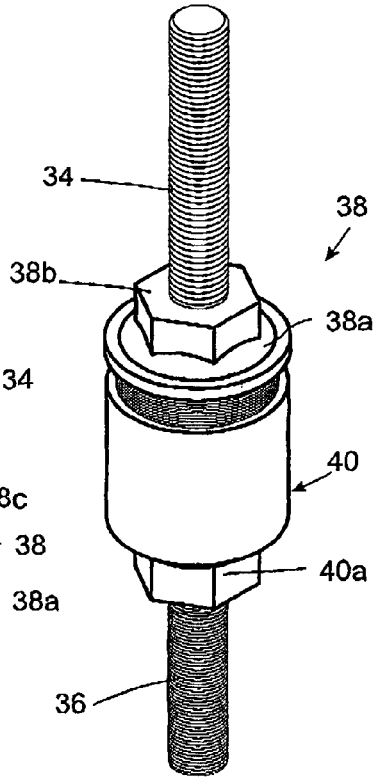

Referring now to FIGS. 3, 4 and 5 and using the same numbering as for FIG. 2, there in shown various views of the apparatus from different angles. In all views, the first 38 and second 40 tubular members have been screwed tight thereby encapsulating and locking in place the adjustment nut (not shown). It is apparent in all views that the opposed threaded studs 34, 36 are substantially coaxially aligned in these views.

As is also shown in FIG. 4, lock nuts 38*c* and 40*b* are optionally provided, which can be tightened against the first and second tubular members (38 and 40, respectively) so as to further secure them on the opposing threaded rods 34 and 36.

Figure 6:
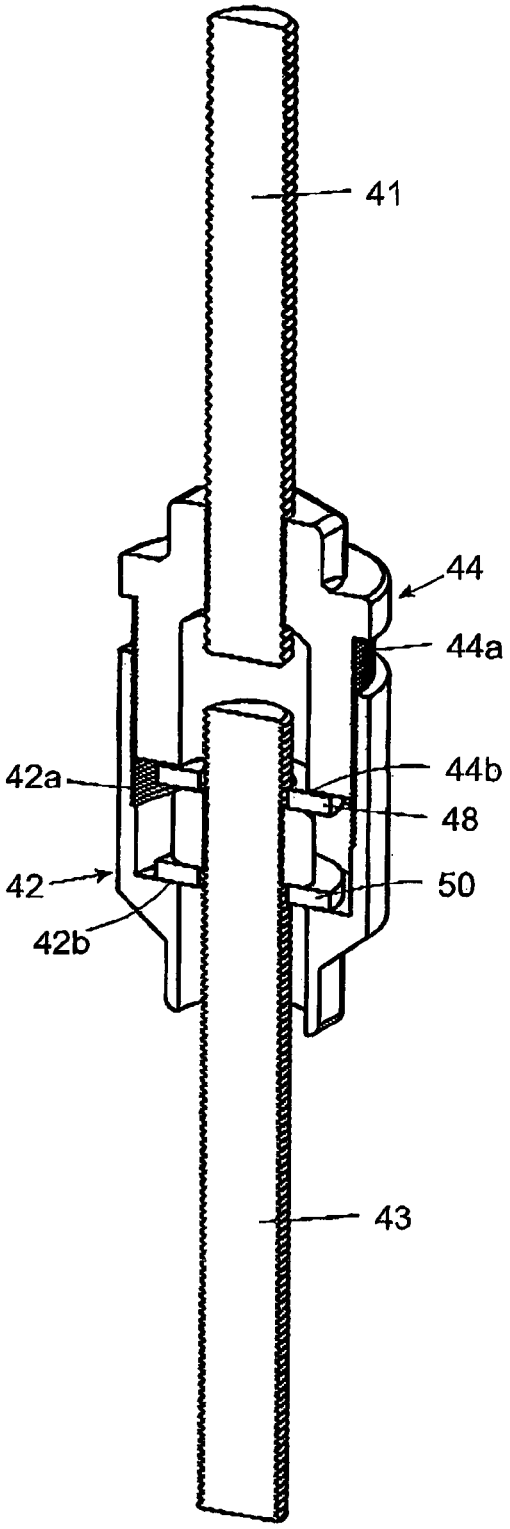
FIG. 6 shows a cross sectional elevation of the invention wherein the opposing studs are substantially aligned.
Figure 7:
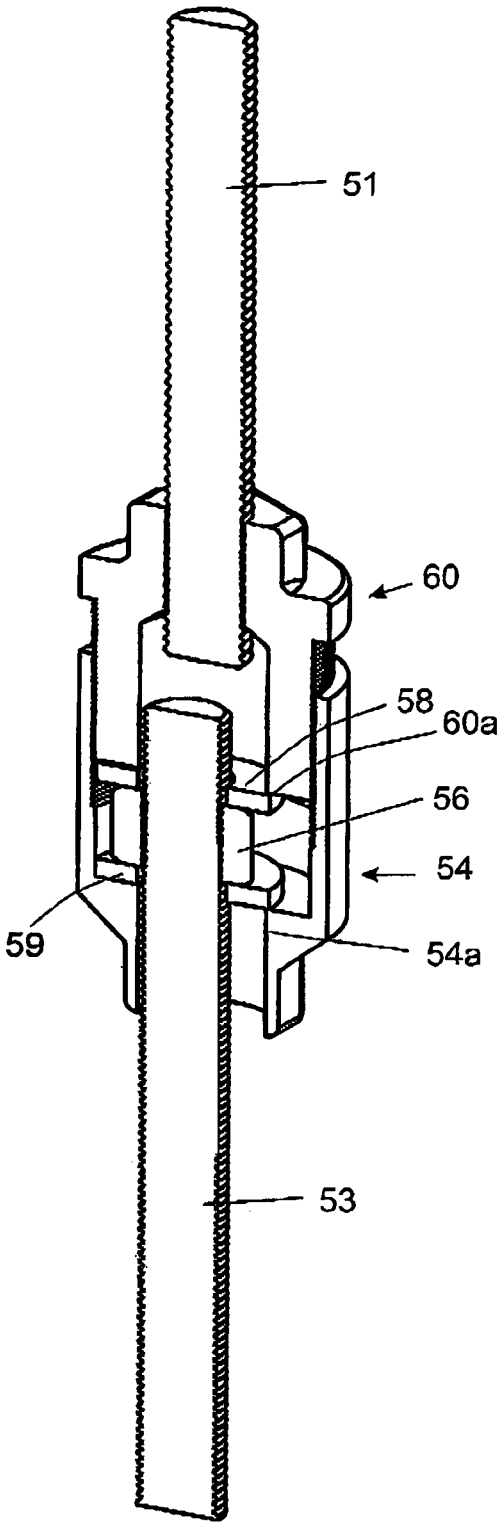
FIG. 7 shows a cross sectional, a elevation of the invention wherein the studs are misaligned.

Referring now to FIGS. 6 and 7 there is shown a cross section elevation of the invention wherein the opposing studs 41, 43 are aligned and misaligned 51, 53 respectively. In the cross sectional view of FIG. 6 the internal thread 42*a* of the second tubular member 42 is shown engaged with the first tubular member 44 having an external thread 44*a* whereby both tubular members have been tightened and overlapped to lock the adjustment nut 46 in place. The adjustment nut is shown with top and bottom washers 48, 50 to facilitate the turning of the adjustment nut and providing additional bearing capacity against the free end 44*b* of the first tubular member and the second tubular member 42*b* respectively. Referring now to FIG. 7 there is shown the apparatus wherein the opposing studs 51, 53 are slightly misaligned. In this case it will be noticed that the hole 54*a* in the end wall of the second interlocking member 54 is of a sufficient diameter to accommodate the misalignment of the opposing stud members 51, 53. The screw jacking function of the adjustment nut 56 is retained as the washers 58, 60 and nut are of a sufficient diameter or dimension to engage the free end 60*a* of the first interlocking member 60. The dimensions of the hole 54*a* in the end wall allow the first and second interlocking members 60, 54 to be aligned along the axes of the stud 51 and can be tightened accordingly to encapsulate and lock the adjustment means 56 in place. As previously discussed concrete can then be poured to seal the apparatus permanently.

Figure 8:
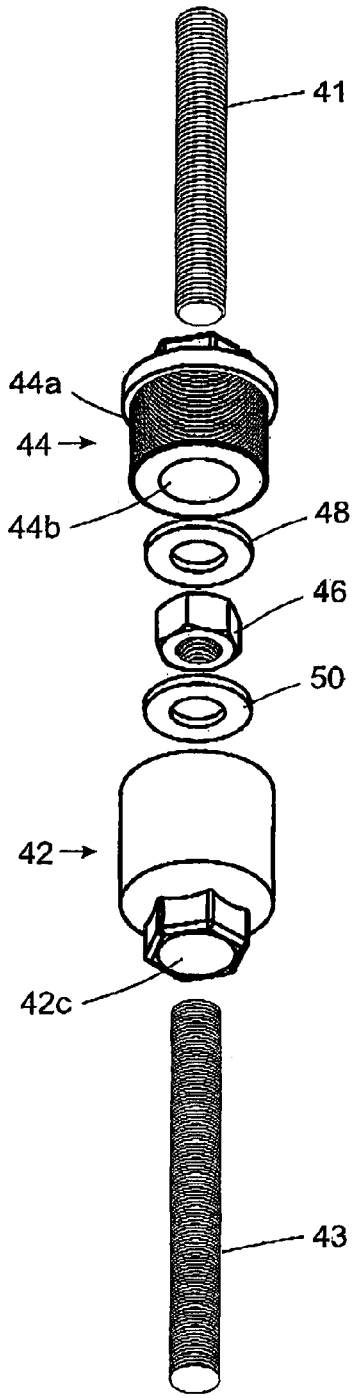
FIGS. 8, 9 and 10 show various exploded views of the invention.
Figure 9:
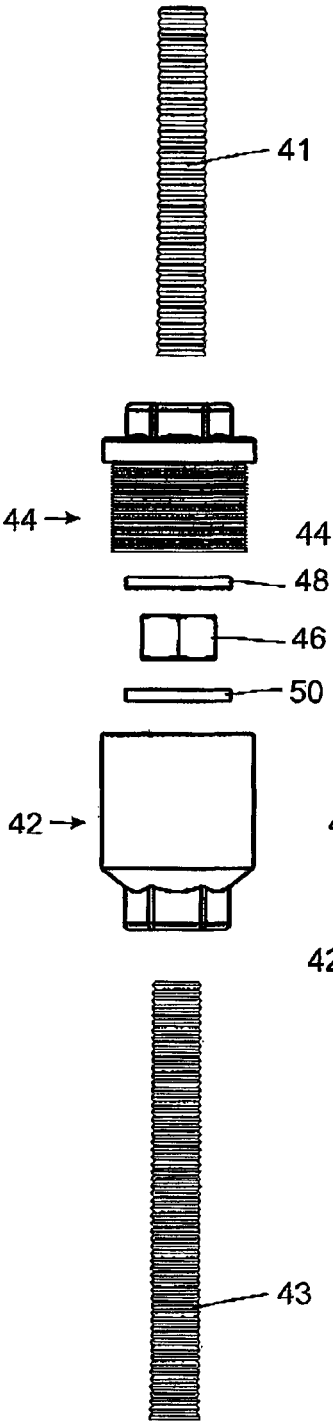
Figure 10:
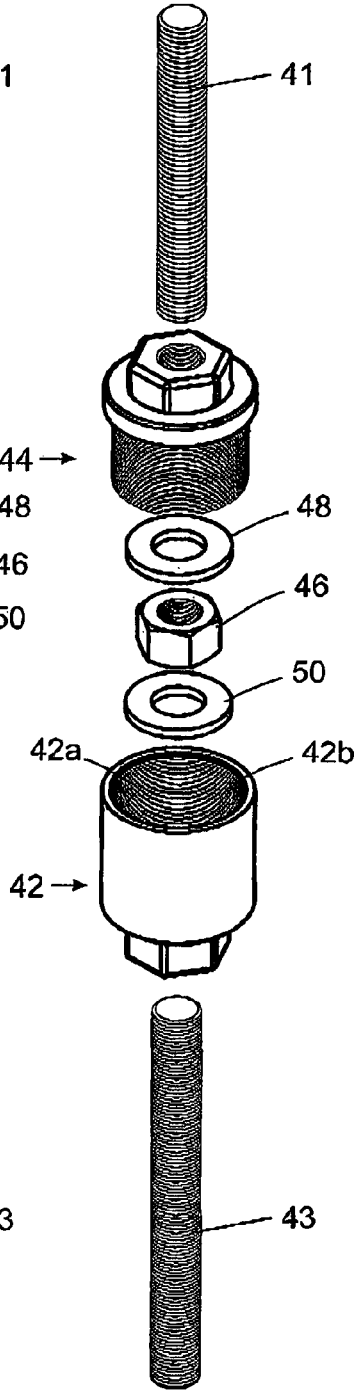

Referring now to FIGS. 8, 9, and 10 there are shown exploded views of a preferred apparatus according to the invention. The same numbering system as for FIGS. 6 and 7 are used. There is shown opposing first and second threaded studs 41, 43 of respective construction elements (not shown) typically concrete columns or posts to be aligned and joined. The first threaded interlocking member 44 with an external screw thread 44*a* is screwed onto the first stud 41. The second interlocking member 42 having an end wall with a hole 42*c* of a diameter preferably equal to or greater than the diameter of the free end of the first interlocking member is slid over the second stud 43. The internal thread 42*a* of the second interlocking member is adapted to engage with the external thread 44*a* of the first interlocking member. The adjustment means comprising an adjustment nut 46 and washers 48, 50 is then screwed on to the second stud 43. The washer 48 is then brought into contact with the free end 44*b* of the first interlocking member 44 and by further turning the adjustment nut effectively screw jacks the first locking member until the desired alignment between the construction elements is achieved. The second interlocking member 42 is then engaged with the first interlocking member 44, and the interlocking members are screwed together. As the second interlocking member is tightened with respect to the first interlocking member it encapsulates and locks the adjustment nut 46. Concrete can then be poured in the space between the respective constructional elements for example a concrete floor can be poured around the apparatus thereby securely fixing the apparatus in place.

Figure 11:
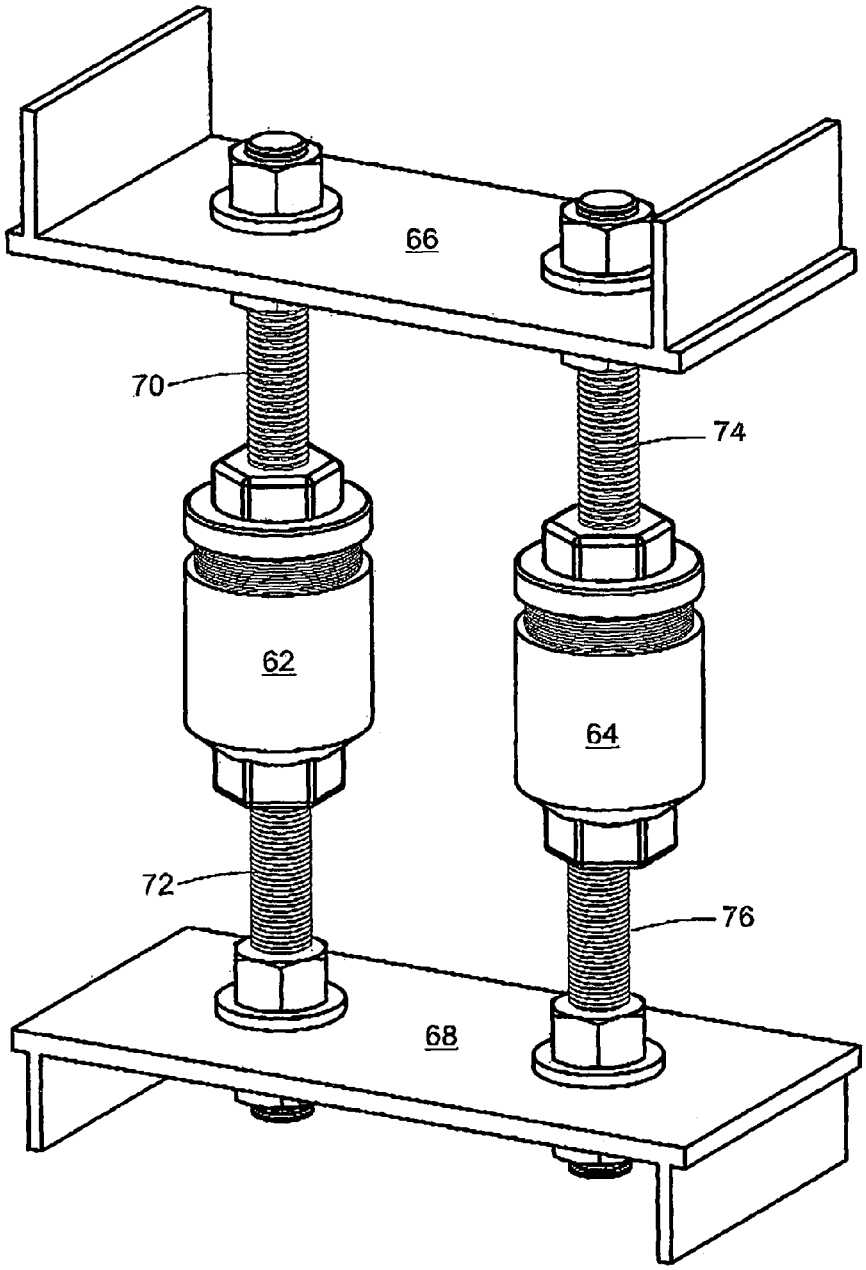
FIG. 11 shows the invention in use to join opposing structural steel elements.
Figure 12:
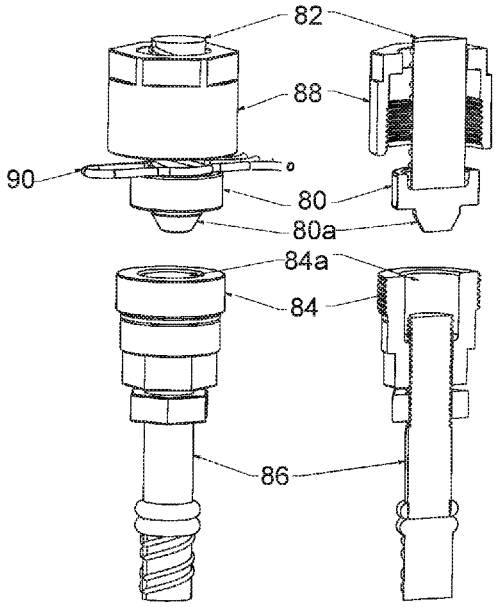
FIGS. 12, 13, 14 and 15 show an assembly of a stud or bar alignment means.

Referring now to FIG. 11 shows a pair of preferred apparatus 62, 64 according to the invention to join and align opposite structural steel elements 66, 68. The threaded rods 70, 72 74 and 76 are bolted to the end flanges of the girders 66, 68. As it would be appreciated the number of units used to align elements will vary accordingly to the building requirements and size of the constructional elements to be connected. Similarly, the preferred apparatus according to the invention could also be used to connect structural steel elements to concrete elements for example, in the case of a steel column with a base plate to a concrete foundation with cast in threaded studs (hold-down bolts).

Referring now to FIGS. 12, 13, 14 and 15 there is shown a preferred stud or bar alignment means. Cap member 80 having a central protrusion 80*a*, the cap adapted to be fitted to the end of stud 82.

Figure 13:
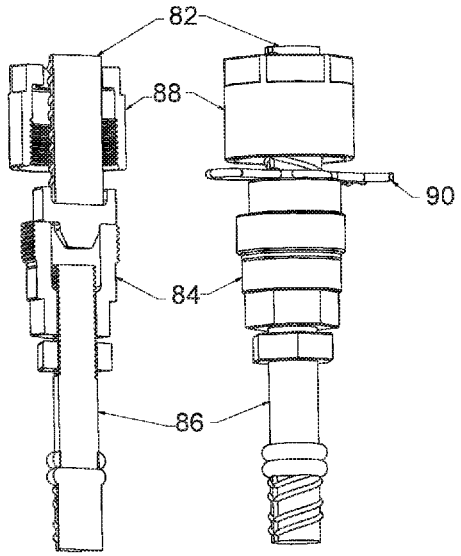
Figure 14:
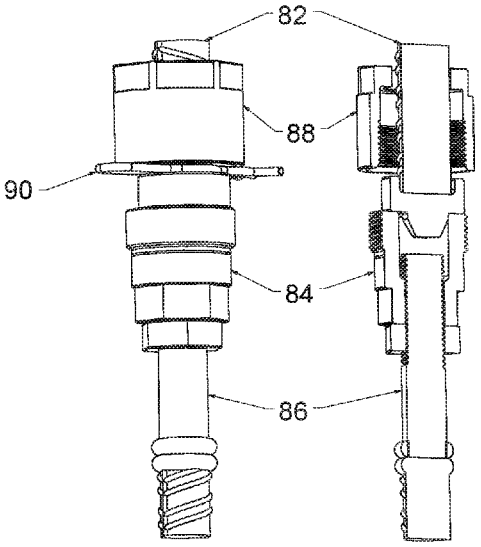

Protrusion 80*a* adapted to be inserted into a central cavity 84*a* of an interlocking tubular member 84 of an opposite stud 86 or bar thereby substantially aligning the opposite studs 82 and 86 shown in FIGS. 13 and 14.

Cap 80 is friction welded or screwed onto the end of stud 82.

Figure 15:
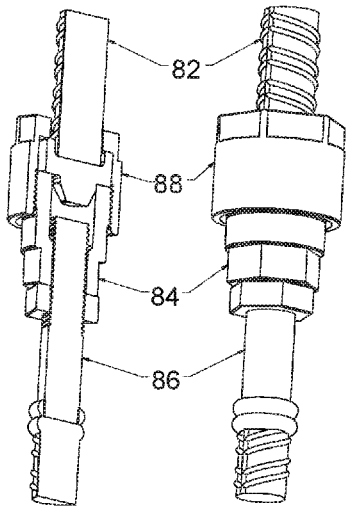

Removable clip 90 is adapted to clip onto studs 82 to temporarily support interlocking tubular member 88 on studs 82 away from a capped end while inserting the protrusion of the cap 80*a* into the central cavity 84*a* to substantially align the opposite studs or bars, 82 and 86. On removing clip 90 tubular members 84 and 88 are then screwed together as shown in FIG. 15.

It will of course be realised that while the foregoing has been given by way of illustrative example of this invention, all such and other modifications and variations thereto as would be apparent to persons skilled in the art are deemed to fail within the broad scope and ambit of this invention as is herein set forth.

Additionally, throughout the specification it should be appreciated that the terms "comprising" and "containing" shall be understood to have a broad meaning similar to the term "including" and will be understood to imply the inclusion of a stated integer or step or group of integers or steps but not the exclusion of any other integer or step or group of integers or steps. This definition also applies to variations on the terms "comprising" and "containing" such as "comprise", "comprises", "contain" and "contains".

Moreover, the term construction or building "elements" are understood to include concrete posts, columns, walls, floors, other reinforced concrete structures as well as steel beams, girders or other steel structures. Where reference is made to studs, they equally apply to reinforcement bars or rods projecting from the construction elements as herein described. In the specific examples provided, the term, threaded studs is interchangeable with reinforcement bars which are externally threaded and vice versa.

The term, screw jacking implies separating or pushing away under a compression force of opposed elements typically the weight of a column or beam being aligned on top another column or beam underneath it.

The invention claimed is:

1. An apparatus for aligning and joining construction elements including concrete columns, walls, beams or structural steel components, comprising:

a first threaded stud or threaded reinforcement bar imbedded in and protruding from an end from a first element;

a second threaded stud or threaded reinforcement bar imbedded in and protruding from a second element to be aligned and joined with the first element;

a first tubular member fixedly attached to the first stud, the first tubular member having a threaded outer wall;

a second tubular member having an internal thread adapted to be screwed onto the first tubular member, the second tubular member having an end wall with a hole to enable the second tubular member to slide over the second stud or bar wherein the dimensions of the hole determines the tolerance required to accommodate any misalignment of the studs;

an adjustment nut screwable onto the second stud and in contact with a free end of the first tubular member wherein the first and the second elements are aligned by screw jacking the adjustment nut against the free end of the first tubular member or vice-versa and wherein the second tubular member when screwed onto the first tubular member encapsulates and locks in place the adjustment nut.

2. The apparatus of claim 1 wherein the construction elements are concrete columns or walls to be vertically aligned.

3. The apparatus of claim 1 wherein the diameter of the hole in the end wall of the second tubular member is equal to or greater than an internal diameter of the free end of the first tubular member.

4. The apparatus of claim 1 wherein there are one or more washers above and below the adjustment nut to facilitate turning of the adjustment nut.

5. The apparatus of claim 4 wherein the washers are designed to provide additional bearing capacity between the adjustment nut and the tubular members.

6. The apparatus of claim 1 wherein the first and second tubular members have hexagonal or flat-faced portions to facilitate turning with a spanner.

7. The apparatus of claim 1 wherein there is one or more lock nuts which can be tightened against the first and second tubular members to further secure them on their respective threaded studs or bars.

8. The apparatus of claim 1 wherein there are removable clips adapted to clip onto the studs or bars to temporarily support one or both of the interlocking tubular members on the studs or bars while aligning the studs or bars.

9. A method of aligning reinforced concrete elements and joining their reinforcement bars or studs using an apparatus for aligning and joining construction elements, the method comprising the steps of:

a) attaching by screwing a first tubular member of the apparatus onto a first stud or bar imbedded in and protruding from an end of a first element;

b) sliding a second tubular member of the apparatus over an opposing second stud or bar imbedded in and protruding from a second element to be aligned and joined with the first element;

c) screwing an adjustment nut of the apparatus onto the opposing second stud or bar and bringing the adjustment nut into contact with a free end of the first tubular member;

d) screw jacking the adjustment nut against the free end of the first tubular member or vice-versa to align the first and second elements; and e) on obtaining a desired alignment, screwing the second tubular member on to the first tubular member and tightening the second and first tubular members together thereby encapsulating and locking into place the adjustment nut.

10. A method of aligning reinforced concrete elements and joining their reinforcement bars or studs using an apparatus for aligning and joining construction elements, the method comprising the steps of:

a) attaching by screwing a first tubular member onto a first stud or bar imbedded in and protruding from an end of a first element;

b) sliding a second tubular member over an opposing second stud or bar imbedded in and protruding from a second element to be aligned and joined with the first element;

c) attaching a cap member onto the second stud or bar and bringing the cap member into contact with a free end of the first tubular member;

d) screw jacking the first tubular member against the cap member to align the first and second elements;

e) on obtaining a desired alignment, screwing the second tubular member on to the first tubular member and tightening the second and first tubular members together thereby encapsulating and locking into place an adjustment nut.

11. An apparatus for aligning and joining construction elements including concrete columns, walls, beams or structural steel components, comprising:

a first threaded stud or threaded reinforcement bar imbedded in and protruding from an end from a first element;

a second threaded stud or threaded reinforcement bar imbedded in and protruding from a second element to be aligned and joined with the first element;

a first tubular member fixedly attached to the first stud, the first tubular member having a threaded outer wall;

a second tubular member having an internal thread adapted to be screwed onto the first tubular member, the second tubular member having an end wall with a hole to enable the second tubular member to slide over the second stud or bar wherein the dimensions of the hole determine the tolerance required to accommodate any misalignment of the studs;

a cap member fitted to an end of the second stud or bar, the cap member having a central protrusion that is adapted to be inserted into a central cavity of the first tubular member such that the first tubular member is screw jacked with respect to the first stud or bar to engage the cap member to thereby substantially align the first and second studs or bars before screwing together the first and second tubular members, wherein the second tubular member when screwed onto the first tubular member encapsulates and locks in place the cap member.

12. The apparatus of claim 11 wherein the cap member is friction welded or screwed onto the end of the second stud or bar.

13. The apparatus of claim 11 wherein the protrusion of the cap member is at least partially inserted into the central cavity of the first tubular member to thereby substantially align the first and second studs or bars.

* * * * *